US008950844B2

(12) United States Patent
Takahashi et al.

(10) Patent No.: US 8,950,844 B2
(45) Date of Patent: Feb. 10, 2015

(54) INKJET PRINTING APPARATUS

(75) Inventors: Atsushi Takahashi, Kawasaki (JP); Yuji Hamasaki, Kawasaki (JP); Kei Yoshizawa, Tokyo (JP); Yoshinori Nakagawa, Kawasaki (JP); Nobuhiro Kitabatake, Kawasaki (JP); Seiji Ogasawara, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 13/217,921

(22) Filed: Aug. 25, 2011

(65) Prior Publication Data

US 2012/0050400 A1 Mar. 1, 2012

(30) Foreign Application Priority Data

Aug. 31, 2010 (JP) ..... 2010-194746

(51) Int. Cl.

*B41J 29/393* (2006.01)
*B41J 11/00* (2006.01)
*B41J 11/06* (2006.01)

(52) U.S. Cl.

CPC ..... *B41J 11/0065* (2013.01); *B41J 11/06* (2013.01)
USPC ..... 347/19

(58) Field of Classification Search

USPC ..... 347/14, 19, 15
See application file for complete search history.

(56) References Cited

U.S. PATENT DOCUMENTS

| | | | | |
|---|---|---|---|---|
| 6,820,962 | B2 | 11/2004 | Uchida | |
| 6,991,327 | B2 * | 1/2006 | Goto et al. | 347/96 |
| 7,926,906 | B2 | 4/2011 | Masuda et al. | |
| 2012/0050370 | A1 | 3/2012 | Iritani et al. | |

FOREIGN PATENT DOCUMENTS

| | | | |
|---|---|---|---|
| JP | 2004-025557 | A | 1/2004 |
| JP | 2004-174978 | A | 6/2004 |
| JP | 2005-74653 | A | 3/2005 |
| JP | 2005-153395 | A | 6/2005 |
| JP | 2006-240173 | A | 9/2006 |
| JP | 2007-111991 | A | 5/2007 |
| JP | 2008-062609 | A | 3/2008 |
| JP | 2008-173963 | A | 7/2008 |
| JP | 2009-132107 | A | 6/2009 |
| JP | 2009-262353 | A | 11/2009 |

OTHER PUBLICATIONS

Office Action mailed Mar. 11, 2014, in Japanese Patent Application No. 2010-194746, Japanese Patent Office.
Office Action mailed Sep. 30, 2014, in Japanese Patent Application No. 2010-194746.

* cited by examiner

*Primary Examiner* — Lamson Nguyen
(74) *Attorney, Agent, or Firm* — Fitzpatrick, Cellla, Harper & Scinto

(57) ABSTRACT

An inkjet printing apparatus is provided which minimizes the amount of inks consumed for preventing the sedimentation of ejected inks on the platen ink absorber and which can effectively prevent the sedimentation of inks. To this end, a comparison is made between the ejected volume of easily sedimenting inks and the ejected volume of sedimentation restraining inks in terms of ink components. If the ejected volume of the sedimentation restraining inks is found not enough, a required amount of sedimentation restraining ink is additionally ejected.

20 Claims, 11 Drawing Sheets

| INKS | NUMBER OF DROPS RESULTING IN SEDIMENTATION |
|---|---|
| GRAY | NO SEDIMENTS |
| PHOTO BLACK | 100 |
| LIGHT GRAY | NO SEDIMENTS |
| DARK GRAY | NO SEDIMENTS |
| LIGHT CYAN | NO SEDIMENTS |
| MAGENTA | 200 |
| YELLOW | 350 |
| LIGHT MAGENTA | NO SEDIMENTS |
| CYAN | 200 |
| RED | 350 |
| CLEAR | NO SEDIMENTS |

FIG.4

RATIO OF INK VOLUME REQUIRED TO PREVENT SEDIMENTATION OF EASILY SEDIMENTING INKS

| | REQUIRED RATIO SEDIMENTATION RESTRAINING INKS | | | | | |
|---|---|---|---|---|---|---|
| EASILY SEDIMENTING INKS | LIGHT CYAN | GRAY | LIGHT GRAY | DARK GRAY | LIGHT MAGENTA | CLEAR |
| PHOTO BLACK | 0.5 | 0.5 | 1.0 | 1.0 | 1.0 | 1.0 |
| CYAN | 0.4 | 0.4 | 0.8 | 0.8 | 0.8 | 0.8 |
| MAGENTA | 0.4 | 0.4 | 0.8 | 0.8 | 0.8 | 0.8 |
| RED | 0.3 | 0.3 | 0.6 | 0.6 | 0.6 | 0.6 |
| YELLOW | 0.3 | 0.3 | 0.6 | 0.6 | 0.6 | 0.6 |

FIG.5

RATIO OF VOLUME OF LIGHT CYAN REQUIRED TO PREVENT SEDIMENTATION OF EASILY SEDIMENTING INKS

| | TIME THAT ELAPSED FROM INK EJECTION | | |
|---|---|---|---|
| | 0 | 480 | 1200 |
| PHOTO BLACK | 0.5 | 3.0 | 8.0 |
| CYAN | 0.4 | 2.4 | 6.5 |
| MAGENTA | 0.4 | 2.4 | 6.5 |
| RED | 0.3 | 1.8 | 5.0 |
| YELLOW | 0.3 | 1.8 | 5.0 |

FIG.6

VALUES OF COEFFICIENTS A, B, C USED AT DIFFERENT TEMPERATURES AND DIFFERENT HUMIDITIES

| [REGIONS A, B, C] | HUMIDITY (%) | | | | | | | | | |
|---|---|---|---|---|---|---|---|---|---|---|
| TEMPERATURE (°C) | 0≦H<10 | 10≦H<20 | 20≦H<30 | 30≦H<40 | 40≦H<50 | 50≦H<60 | 60≦H<70 | 70≦H<80 | 80≦H<90 | 90≦H<100 |
| T < 10 | (0.3,0.2,0.1) | (0.3,0.2,0.1) | (0.3,0.2,0.1) | (0.2,0.1,0.1) | (0.2,0.1,0.1) | (0.2,0.1,0.1) | (0.2,0.1,0.1) | (0.1,0.1,0.1) | (0.1,0.1,0.1) | (0.1,0.1,0.1) |
| 10≦H<20 | (0.3,0.2,0.1) | (0.3,0.2,0.1) | (0.3,0.2,0.1) | (0.3,0.2,0.1) | (0.2,0.1,0.1) | (0.2,0.1,0.1) | (0.2,0.1,0.1) | (0.1,0.1,0.1) | (0.1,0.1,0.1) | (0.1,0.1,0.1) |
| 20≦H<30 | (0.5,0.4,0.3) | (0.3,0.2,0.1) | (0.3,0.2,0.1) | (0.3,0.2,0.1) | (0.3,0.2,0.1) | (0.2,0.1,0.1) | (0.2,0.1,0.1) | (0.1,0.1,0.1) | (0.1,0.1,0.1) | (0.1,0.1,0.1) |
| 30 ≦ T | (0.5,0.4,0.3) | (0.5,0.4,0.3) | (0.3,0.2,0.1) | (0.3,0.2,0.1) | (0.3,0.2,0.1) | (0.3,0.2,0.1) | (0.2,0.1,0.1) | (0.1,0.1,0.1) | (0.1,0.1,0.1) | (0.1,0.1,0.1) |

FIG.7

[REGIONS A, C, D]

| VALUE OF D | HUMIDITY (%) | | | | | | | | | |
|---|---|---|---|---|---|---|---|---|---|---|
| TEMPERATURE (°C) | 0≦H<10 | 10≦H<20 | 20≦H<30 | 30≦H<40 | 40≦H<50 | 50≦H<60 | 60≦H<70 | 70≦H<80 | 80≦H<90 | 90≦H<100 |
| T < 10 | 0.5 | 0.3 | 0.3 | 0.3 | 0.3 | 0.1 | 0.1 | 0.1 | 0.1 | 0.1 |
| 10≦H<20 | 0.5 | 0.5 | 0.3 | 0.3 | 0.3 | 0.3 | 0.1 | 0.1 | 0.1 | 0.1 |
| 20≦H<30 | 0.5 | 0.5 | 0.5 | 0.3 | 0.3 | 0.3 | 0.3 | 0.1 | 0.1 | 0.1 |
| 30 ≦ T | 0.5 | 0.5 | 0.5 | 0.5 | 0.3 | 0.3 | 0.3 | 0.3 | 0.1 | 0.1 |

FIG.8A

[REGIONS B]

| VALUE OF D | HUMIDITY (%) | | | | | | | | | |
|---|---|---|---|---|---|---|---|---|---|---|
| TEMPERATURE (°C) | 0≦H<10 | 10≦H<20 | 20≦H<30 | 30≦H<40 | 40≦H<50 | 50≦H<60 | 60≦H<70 | 70≦H<80 | 80≦H<90 | 90≦H<100 |
| T < 10 | 2 | 2 | 2 | 1 | 1 | 1 | 1 | 0.5 | 0.5 | 0.5 |
| 10≦H<20 | 2 | 2 | 2 | 2 | 1 | 1 | 1 | 1 | 0.5 | 0.5 |
| 20≦H<30 | 3 | 2 | 2 | 2 | 2 | 1 | 1 | 1 | 1 | 0.5 |
| 30 ≦ T | 3 | 3 | 2 | 2 | 2 | 2 | 1 | 1 | 1 | 1 |

FIG.8B

| FIG.10A | FIG.10B |
|---|---|

INKJET PRINTING APPARATUS

BACKGROUND OF THE INVENTION

1. Field of the Invention

The present invention relates to an inkjet printing apparatus that uses inks to form an image.

2. Description of the Related Art

In inkjet printing apparatus using ink with lower solubility than conventional ink (hereinafter referred to as easily settling or sedimenting ink), when ink is repetitively ejected onto an ink receiver during a marginless printing and a cleaning ejection—an operation which ejects ink not for printing but for cleaning nozzles of a print head—the ejected ink may settle in the ink receiver or flow path, clogging the flow paths or forming ink sediments on the ink receiver. The ink sediments may flow out of the ink receiver, contaminating its surroundings, smearing a print medium or coming into contact with a print head face formed with nozzle openings. So, in the printing apparatus using easily sedimenting inks, a control to prevent sedimentation of ink constitutes an important technical issue.

To deal with this problem of the conventional inkjet printing apparatus, Japanese Patent Laid-Open No. 2008-62609 offers a technique that determines the amount of sedimentation restraining inks, that needs to be ejected onto a platen ink absorber to prevent ink sedimentation on it, in relation to the amount of easily sedimenting inks and which measures the volume of, or performs dot counting of, each ink color applied to each of divided regions of the platen ink absorber and determines with high precision an amount of sedimentation restraining inks to be applied to each region.

The conventional technique determines the amount of sedimentation restraining inks based on the dot count of easily sedimenting inks. It claims to be able to determine the amount of sedimentation restraining inks with high accuracy by dividing the platen ink absorber into a plurality of regions and performing dot counting in each of the regions. That is, it determines the amount of sedimentation restraining inks to be applied by considering only the amount of easily sedimenting inks already ejected.

The amount of sedimentation restraining inks for preventing ink sedimentation should be determined by considering not only the amount of easily sedimenting inks but also a component ratio of the easily sedimenting inks, a state of the platen ink absorber and a remaining ink volume. Japanese Patent Laid-Open No. 2008-62609 therefore has a problem that, in some cases, it may not be able to determine or eject an appropriate amount of sedimentation restraining inks for preventing ink sedimentation.

SUMMARY OF THE INVENTION

It is therefore an object of this invention to provide an inkjet printing apparatus capable of reducing the consumption of the sedimentation restraining inks applied to the platen ink absorber and thereby effectively preventing ink sedimentation.

An inkjet printing apparatus of this invention comprises: a printing device having a first ink group and a second ink group that prevents a sedimentation of the first ink group; a platen ink absorber to receive the inks ejected from the printing device during a marginless printing; a counting device to count, for each of a plurality of regions into which the platen ink absorber is divided, ink volumes of the first ink group and the second ink group ejected from the printing device; and an estimation device to estimate a ratio of ink components for each of the color inks and for each of the plurality of regions; wherein, from a result of estimation by the estimation device and from a result of counting by the counting device, a decision is made as to the first ink group will sediment on the platen ink absorber; wherein, when it is decided that the first ink group will sediment, an ink of the second ink group is ejected.

According to this invention, the inks used in the inkjet printing apparatus are divided into a first ink group that easily sediment after being ejected and a second ink group that prevents sedimentation of ejected inks. The inkjet printing apparatus has the counting device to measure the ejected volumes of the first ink group and second ink group for each of a plurality of divided regions of the platen ink absorber during the marginless printing. The inkjet printing apparatus also has the estimation device to estimate the ratio of ink components ejected onto the platen ink absorber for each of the color inks and for each of the plurality of regions.

From a result of estimation by the estimation device and from a result of counting by the counting device, a decision is made as to whether or not the first ink group will sediment on the platen ink absorber. When it is decided that the first ink group will sediment, an amount of the second ink group enough to prevent the sedimentation is ejected. With this arrangement, an inkjet printing apparatus can be realized which can reduce consumption of the inks that prevents ink sedimentation on the platen ink absorber and thereby effectively prevent possible ink sedimentation.

Further features of the present invention will become apparent from the following description of exemplary embodiments (with reference to the attached drawings).

BRIEF DESCRIPTION OF THE DRAWINGS

FIG. 4 is a tabled result of experiment showing whether sediments are formed after inks are ejected;

FIG. 5 is a tabled result of experiment showing sedimentation prevention effectiveness of inks;

FIG. 6 shows volumes of Light Cyan required to prevent sedimentation of inks;

FIG. 7 is a table of coefficients used at different temperatures and different humidities;

FIG. 8A shows coefficient d used in regions A, C and D;

FIG. 8B shows coefficient d used in region B;

DESCRIPTION OF THE EMBODIMENTS (First Embodiment)

Now, a first embodiment of this invention will be described by referring to the accompanying drawings.

(Construction of Printing Apparatus)

Figure 1:
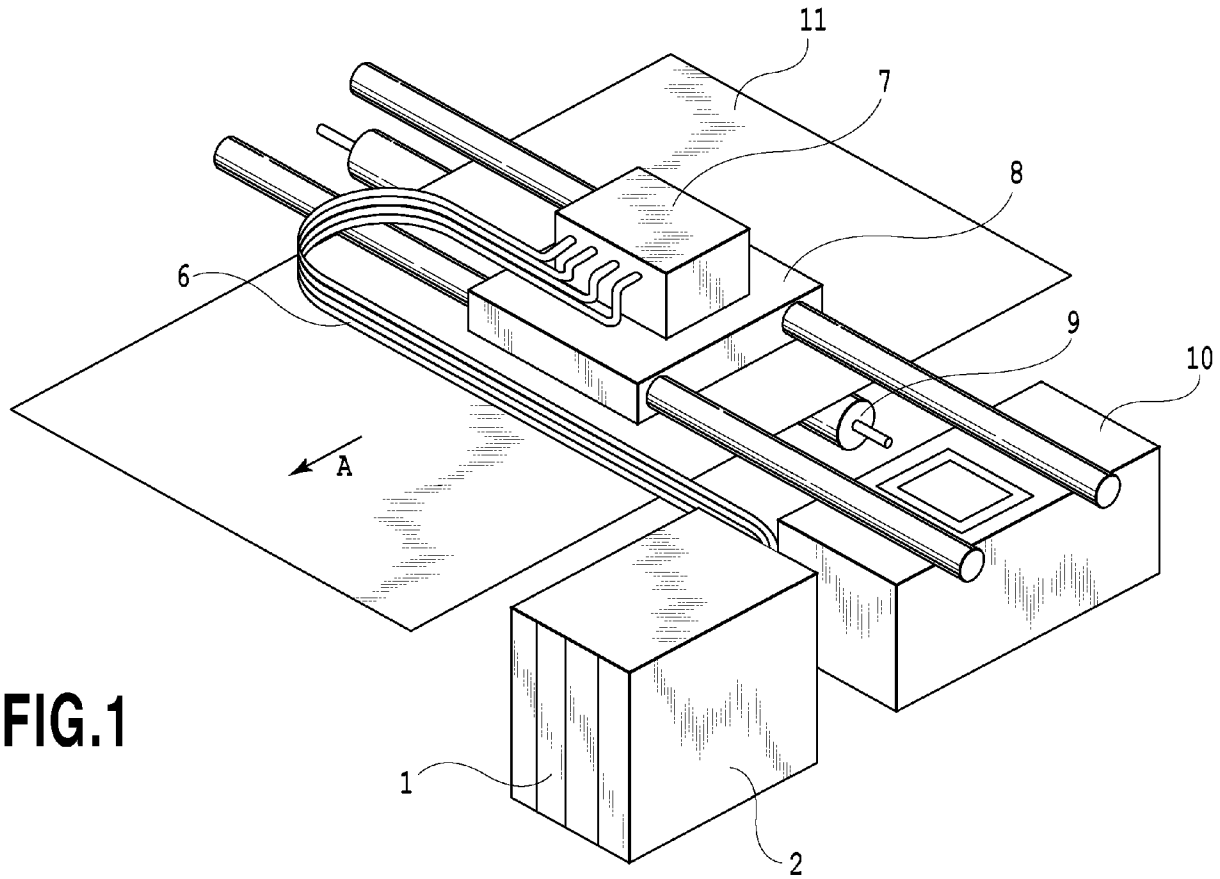
FIG. 1 is a schematic view showing a construction of the inkjet printing apparatus of this embodiment.

FIG. 1 is a schematic view showing a construction of the inkjet printing apparatus (simply referred to as a printer) in this embodiment. An ink tank is disposed on both sides of a print medium or print sheet 11 (not shown). The ink tank 1 is mounted on an ink tank holder 2 on a printer body and supplies ink to a subtank 7 mounted on a carriage 8 through an ink supply tube 6. The printer causes its print head connected to the subtank 7 to move over a platen that supports the print medium and eject ink from its nozzles to form an image on the print medium. During a nozzle recovery operation such as a suction operation for maintaining the nozzle ejection in good condition, the print head moves to a position of a recovery unit 10. The recovery unit 10 incorporates a vacuum pump.

(Marginless Printing and Dot Count)

Figure 2:
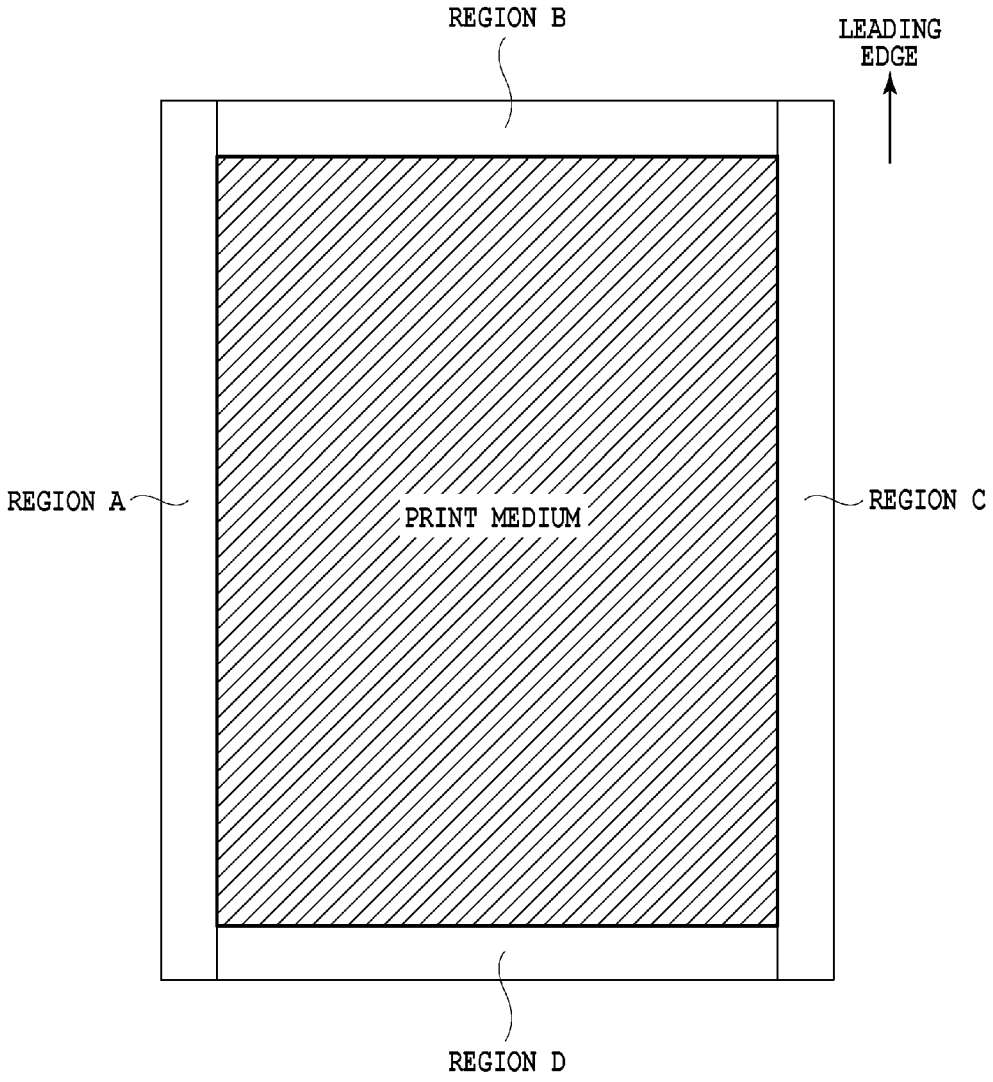
FIG. 2 shows areas or regions to which ink is ejected in the printing apparatus of this embodiment.

FIG. 2 shows an ink application area on a print medium in a printer of this embodiment. In a so-called marginless printing whereby the printing is done to the edges of the print medium, this embodiment provides four regions along the edges of the print medium—region A (immediately beyond a left edge of the print medium), region B (immediately beyond a leading edge), region C (immediately beyond a right edge) and area D (immediately beyond a trailing edge)—not to leave any unprinted or blank area on the print medium, as shown in FIG. 2. In these left/right edge regions and leading/trailing edge regions, there are provided beyond-edge regions which extend outwardly from the print medium edges. Ink is ejected onto the entire print medium and these beyond-edge regions spreading outwardly from the edges by 2.8 mm in the region A, 2 mm in the region B, 2.8 mm in the region C and mm in the region D. These beyond-edge widths or overrunning widths from the edges are set allowing for maximum errors, such as print medium conveyance error, slanting error and paper feeding error, so that no unprinted area is left on the print medium. Ink that has been ejected outside the print medium falls on a platen ink absorber.

In this embodiment, a volume of ink ejected onto the individual regions A, B, C and D is counted and stored for each ink color. First, the number of ink dots ejected to each of these regions is counted for each ink color. Next, based on a predetermined ink volume of each dot for each ink color, the ejection volume of one dot is multiplied by the number of dots to calculate the ink volume ejected onto the platen ink absorber.

Figure 3:
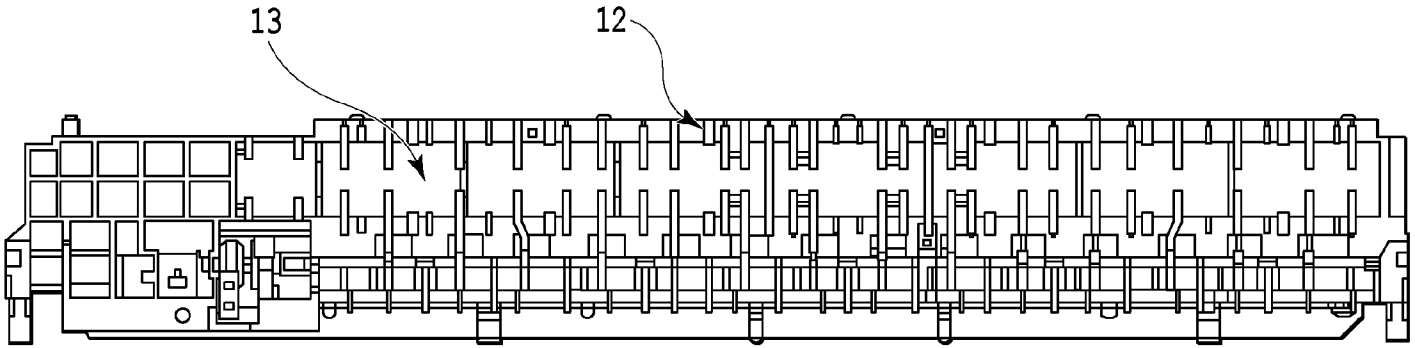
FIG. 3 shows a platen and a platen ink absorber in the printing apparatus.

FIG. 3 shows a platen 12 and a platen ink absorber 13 in the printer that can apply this embodiment. As for the ink ejection onto the leading edge region B and the trailing edge region D shown in FIG. 2, although ink dots are actually ejected at partly overlapping positions on the platen ink absorber 13, the calculation of the ejected ink volume for each ink color is done for each of the regions A, B, C, D, as described above. This is because, even at the same positions on the platen ink absorber 13, the applied volume of each ink differs between the regions B and the region D and because the elapsed time following the ink application differs between different regions, the inks in different regions have different viscosities and therefore different ink volumes required to prevent accumulation of viscous ink.

(Ink Components and Viscous Ink Formation)

The printer of this embodiment forms an image with 12 colors of pigment ink: Gray, Photo Black, Light Gray, Dark Gray, Light Cyan, Magenta, Yellow, Light Magenta, Matte Black, Cyan, Red and Clear (image quality improvement transparent liquid). The formation of viscous ink refers to a phenomenon in which, when ejected onto a platen ink absorber, ink fails to penetrate into it and remains on its surface. This phenomenon is likely to occur with inks that contain colorants with low solubility or which tend to easily increase their viscosity on evaporation and lose their fluidity. Inks with such a property are referred to as easily sedimenting inks.

Of the 12 colors of ink, Photo Black, Magenta, Yellow, Matte Black, Cyan and Red are six easily sedimenting inks. These are called a first ink group. It is noted, however, that Matte Black is not used for the marginless printing but only used on special print media, such as art paper. So, there is no chance of Matte Black being ejected onto the platen ink absorber 13. In this embodiment, therefore, the accumulation of Matte Black is not considered and the following description concerns the remaining 11 ink colors.

Six inks other than the easily sedimenting inks—Gray, Light Gray, Dark Gray, Light Cyan, Light Magenta and Clear—do not easily settle on the platen ink absorber. These inks, when mixed with or applied over the easily sedimenting inks, produce an effect of preventing ink sedimentation on the absorber. These six color inks that help prevent the sedimentation are referred to as a second ink group. These easily sedimenting inks and sedimentation restraining inks can be distinguished by experiments described below.

(Experiment 1: Determining Whether Ink Easily Sediments)

A device is prepared to drop ink on the platen ink absorber and, in a high-temperature, low-humidity environment, an ink of interest is intermittently dropped. After a predetermined number of ink drops are allowed to fall, a check is made as to whether there is any deposit formed on the platen ink absorber 13, to determined whether the ink of interest is an easily sedimenting ink. Further, by measuring the number of drops that has resulted in the formation of an ink sediment, the level of ease with which the ink of interest settles can be evaluated. In this embodiment, an experiment has been conducted whereby at a temperature of 30° C. and a humidity of 10%, ink is dropped on the platen ink absorber 13 at intervals of 300 seconds at a density of 32 ng of ink in an area 600 dpi long and 600 dpi wide.

FIG. 4 is a result of the experiment showing whether deposits are formed after inks have been applied. The result shows that the inks sediment in the following descending order of ease: Photo Black>Cyan≈Magenta>Red≈Yellow. This order is found to match a descending order of content of solid components in the inks.

(Experiment 2: Determining Whether Ink Restrains Sedimentation)

The inks to be tested in this experiment are those that did not sedimented in the preceding experiment 1. In a hot, dry atmosphere, the easily sedimenting inks are dropped intermittently and at the same time the inks to be tested that did not sedimented are also dropped. Alternatively, the target inks are dropped a predetermined time after the easily sedimenting inks are dropped. It can be determined whether the tested ink can reduce sedimentation by checking if there is formed a sediment on the platen ink absorber after a predetermined number of ink droplets have been applied to the absorber. It is also possible to determine a ratio of a sedimentation restraining ink to an easily sedimenting ink that, when the former is ejected simultaneously with the latter, can effectively prevent the sedimentation of the easily sedimenting inks or a ratio of a sedimentation restraining ink to an easily sedimenting ink that, when the former is ejected a predetermined time after the ejection of the latter, can effectively prevent the sedimentation of the easily sedimenting inks.

In this embodiment, at a temperature of 30° C. and a humidity of 10%, the easily sedimenting inks are dropped on the platen ink absorber 13 at intervals of 300 seconds at a density of 32 ng of ink in an area 600 dpi long and 600 dpi wide. At the same time, the inks to be tested are also applied to the same positions as the easily sedimenting inks. This test has been conducted under a plurality of conditions for a plurality of combinations of the easily sedimenting inks and the sedimentation restraining inks.

FIG. 5 is a result of experiments showing the sedimentation prevention effect for each ink color. The result shows that the inks can prevent sedimentation in the following descending order of effectiveness: Light Cyan≈Gray>Light Gray≈Light Magenta≈Dark Gray≈Clear. This order in this embodiment is found to match an ascending order of content of solid components in the inks.

FIG. 6 shows a result of measurements of the volume of Light Cyan required to prevent the ink sedimentation. At a temperature of 30° C. and a humidity of 10%, the easily sedimenting inks are dropped on the platen ink absorber 13 at a density of 32 ng of ink in an area 600 dpi long and 600 dpi wide. A predetermined time later, Light Cyan ink is applied to the same positions as the easily sedimenting inks. The result of this experiment has found that, as the time that elapses from the application of the easily sedimenting inks increases, the required volume of Light Cyan ink increases because the increased lapsed time promotes the evaporation of the easily sedimenting inks, making it easier for them to sediment.

(Calculation of Required Volume of Sedimentation Restraining Inks)

Volumes of Photo Black, Magenta, Yellow, Cyan and Red inks in the first ink group are represented as PBk, Ma, Ye, Cy and Re. Volumes of Gray, Light Gray, Dark Gray, Light Cyan, Light Magenta and Clear inks in the second ink group are represented as Gy, LGy, DGy, Lc, Lm and Cl. From the results of FIG. 4 and FIG. 5, it has been found that, at a temperature of 30° C. and a humidity of 10%, whether the ink of interest ejected onto a certain area on the platen ink absorber will sediment or not can be determined by the following expression:

$$\{(PBk\times0.5+Cy\times0.4+Ma\times0.4+Re\times0.3+Ye\times0.3)-(Lc+Gy+LGy\times0.5+DGy\times0.5+Lm\times0.5+Cl\times0.5)\} \quad (1)$$

The coefficients multiplying the respective ink volumes are weights for each color with the Light Cyan volume Lc and Gray volume Gy taken as references in FIG. 4 and FIG. 5. When the expression (1) is positive, it indicates that the volume of the sedimentation restraining ink is not enough to prevent the sedimentation of the easily sedimenting ink and that, if left as is, the ink is likely to sediment. When the expression (1) is negative, the volume of the sedimentation restraining ink is enough to restrain the sedimentation of the easily sedimenting ink and that, if left as is, the ink is unlikely to sediment.

FIG. 7 shows coefficients used at different temperatures and different humidities. The weighting coefficients in the expression (1) change according to temperature and humidity. So, the expression (1) can be rewritten into an expression (2) and the coefficients a, b and c used in the expression are shown in FIG. 7. The coefficients of the second ink group represent degrees of sedimentation prevention effectiveness with the Light Cyan Lc and Gray Gy taken as references and therefore can considered not to change according to temperature and humidity.

$$\{(PBk\times a+Cy\times b+Ma\times b+Re\times c+Ye\times c)-(Lc+Gy+LGy\times0.5+DGy\times0.5+Lm\times0.5+Cl\times0.5)\} \quad (2)$$

To prevent ink sedimentation on the platen ink absorber 13, calculation is done using the expression (2) for each of the regions A-D of the platen ink absorber 13 shown in FIG. 2. Depending on the result of the calculation, the corresponding control is performed. That is, if the calculated result is positive, the second ink group is additionally applied to prevent sedimentation. If the result is negative, nothing is performed.

From the expression (2), a decision can be made of whether the ejection of the sedimentation restraining inks (also referred to simply as a sedimentation prevention ejection) is necessary or not, for each region of the platen ink absorber 13. However, the required volume of sedimentation prevention ejection needs to take into consideration the time which elapses from the ejection of ink onto the platen ink absorber 13 during the marginless printing to the execution of sedimentation prevention ejection. This is because the sedimentation prevention ejection is only performed after the marginless printing is finished and the print medium is discharged, during which time the ink that has fallen on the platen ink absorber 13 keeps evaporating and thus becomes more likely to sediment.

For example, unlike the regions A, C and D in which the ink keeps falling on these regions until immediately before the initiation of the sedimentation prevention ejection, the region B after being applied with ink spends time more than its printing time waiting for the sedimentation prevention ejection to begin. To deal with this problem, the required ink volume for sedimentation prevention ejection is calculated from an expression (3), which is obtained by multiplying the expression (2) with a coefficient d that takes into account the ink evaporation associated with the temperature, humidity and the printing time.

$$\{(PBk\times a+Cy\times b+Ma\times b+Re\times c+Ye\times c)-(Lc+Gy+LGy\times0.5+DGy\times0.5+Lm\times0.5+Cl\times0.5)\}\times d \quad (3)$$

As described above, inks are ejected onto the regions A, C and D of FIG. 2 until immediately before the sedimentation prevention ejection is initiated. But in the region B, more than its printing time has passed from its ink application. So, this embodiment uses the common value of coefficient d shown in FIG. 8A for the regions A, C and D. For the region B the value of coefficient d shown in FIG. 8B is used. Where there are a plurality of printing times as when there are a plurality of print modes, an appropriate coefficient d may be prepared according to the printing time.

(Sedimentation Prevention Ejection Sequence)

Figure 9:
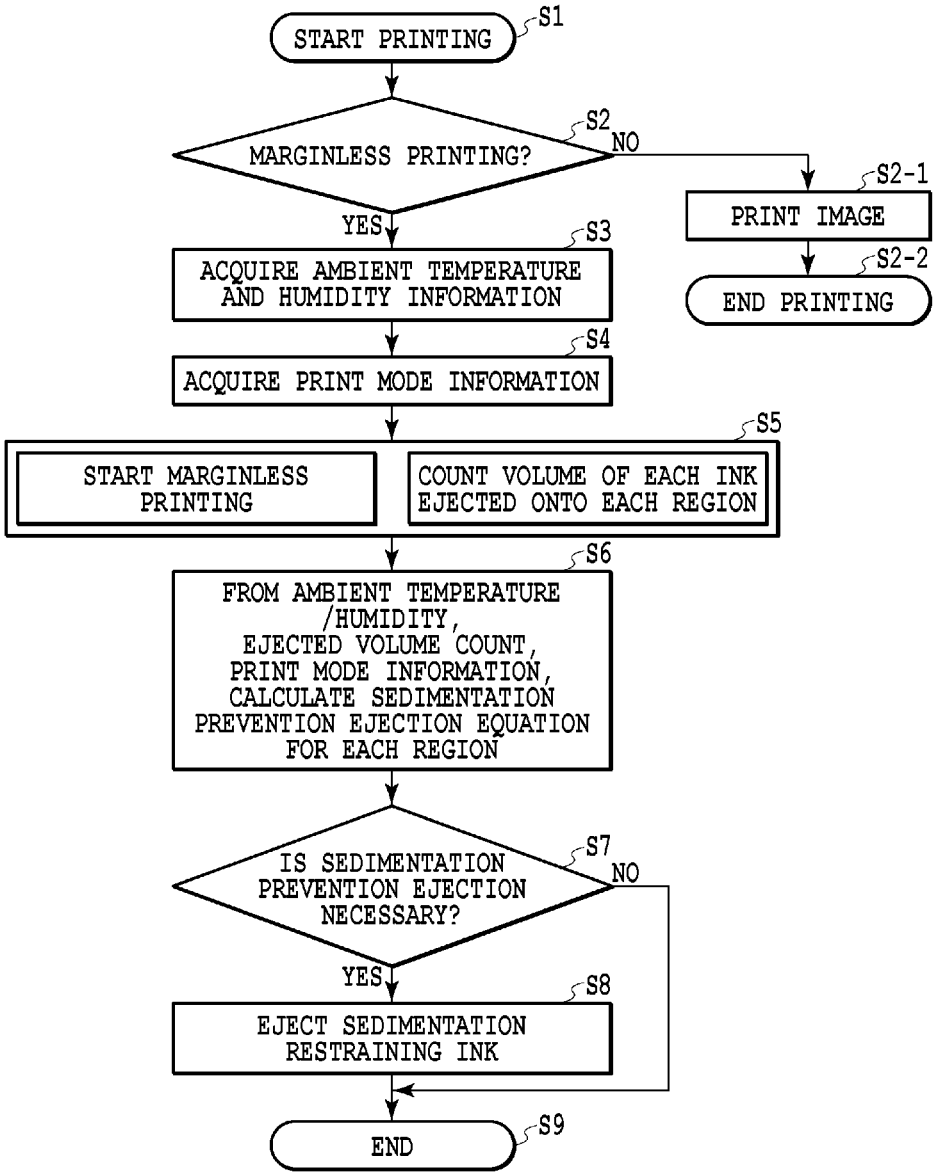
FIG. 9 is a flow chart showing a sequence of steps executed by a printing operation in the embodiment.

FIG. 9 is a flow chart showing a sequence of steps executed in the printing operation of this embodiment. A sequence of the sedimentation prevention ejection will be described as follows. First, on initiation of the printing operation at step S1, the processing moves to steps S2 where it checks if the image it is about to print is by a marginless printing. If it is found that the image is to be printed by other than the marginless printing, the associated printing operation is performed at step S2-1 and ended at step S2-2. If step S2 finds that the image is to be printed by the marginless printing, the processing moves to step S3, where it acquires information on temperature and humidity in the printing environment. In this embodiment, a temperature/humidity sensor is installed in the printing apparatus to acquire information on temperature and humidity in the apparatus. Then in step S4, print mode information is acquired and, in step S5, the marginless printing is performed. At the same time, ink volumes of individual inks ejected onto the beyond-edge regions outside the print medium are counted for each region.

After the printing operation is completed, step S6 calculates the expression (3) for sedimentation prevention ejection in each region, based on the information on temperature/humidity and print mode and the individual ink volumes in each region acquired by step S3, S4, S5. Based on the calculated result from step S6, step S7 decides whether or not the sedimentation prevention ejection is necessary. If the ejection is found necessary, the required volume of the sedimentation restraining ink is calculated (estimated). Step S7 determines that the sedimentation prevention ejection is necessary if the calculated result (estimation) from step S6 is positive, and that it is not necessary if calculated value is negative. Then at step S8 the volume of sedimentation restraining ink calculated by step S7 is ejected. The sequence is now ended. In this embodiment, step S8 uses two inks—Light Cyan and Gray—for sedimentation prevention ejection. Light Cyan and Gray are equal in sedimentation prevention effectiveness, as shown in FIG. 5, and the ink volume calculated at step S7 is therefore equally divided between the two colors. This is intended to avoid uneven ink consumption among different ink colors.

Although in this embodiment the required ink volume for the sedimentation prevention ejection is equally divided between the two colors—Light Cyan and Gray—any other ink colors may be used and the sedimentation prevention ejection volumes of individual ink colors may also be weighted according to their sedimentation prevention effectiveness. While in this embodiment the coefficient d is set using the print mode information, it may be set using a means for measuring the time which has elapsed from the ink ejection onto the platen ink absorber 13. Further, in this embodiment the weighting of the ink volumes is done by considering the level of ease with which the individual inks are likely to sediment and their sedimentation prevention effectiveness. The weighting may also be simply set using a single common coefficient. In executing the sedimentation prevention ejection, the amount of sediment on the platen ink absorber 13 may be estimated from information on temperature and humidity in the printing environment, the print mode information, the time that elapses from the ink ejection, the accumulated number of marginless-printed sheets and the volume of sedimentation restraining inks that have yet to be ejected.

What is referred to as ink components in this embodiment includes an ink viscosity, an ink surface tension, a ratio of insoluble components and a pigment concentration. When the comparison based on these ink components between the volumes of easily sedimenting inks and of sedimentation restraining inks has found that the volume of the sedimentation restraining inks is not enough, the required amount of the latter is ejected. This minimizes the amount of the sedimentation restraining inks applied to the platen ink absorber 13, realizing an inkjet printing apparatus capable of effectively preventing the ink sedimentation.

(Second Embodiment)

A second embodiment of this invention will be described by referring to the drawings. The construction of this embodiment is basically similar to that of the first embodiment and therefore only characteristic construction will be explained.

Figures 10, 10A:
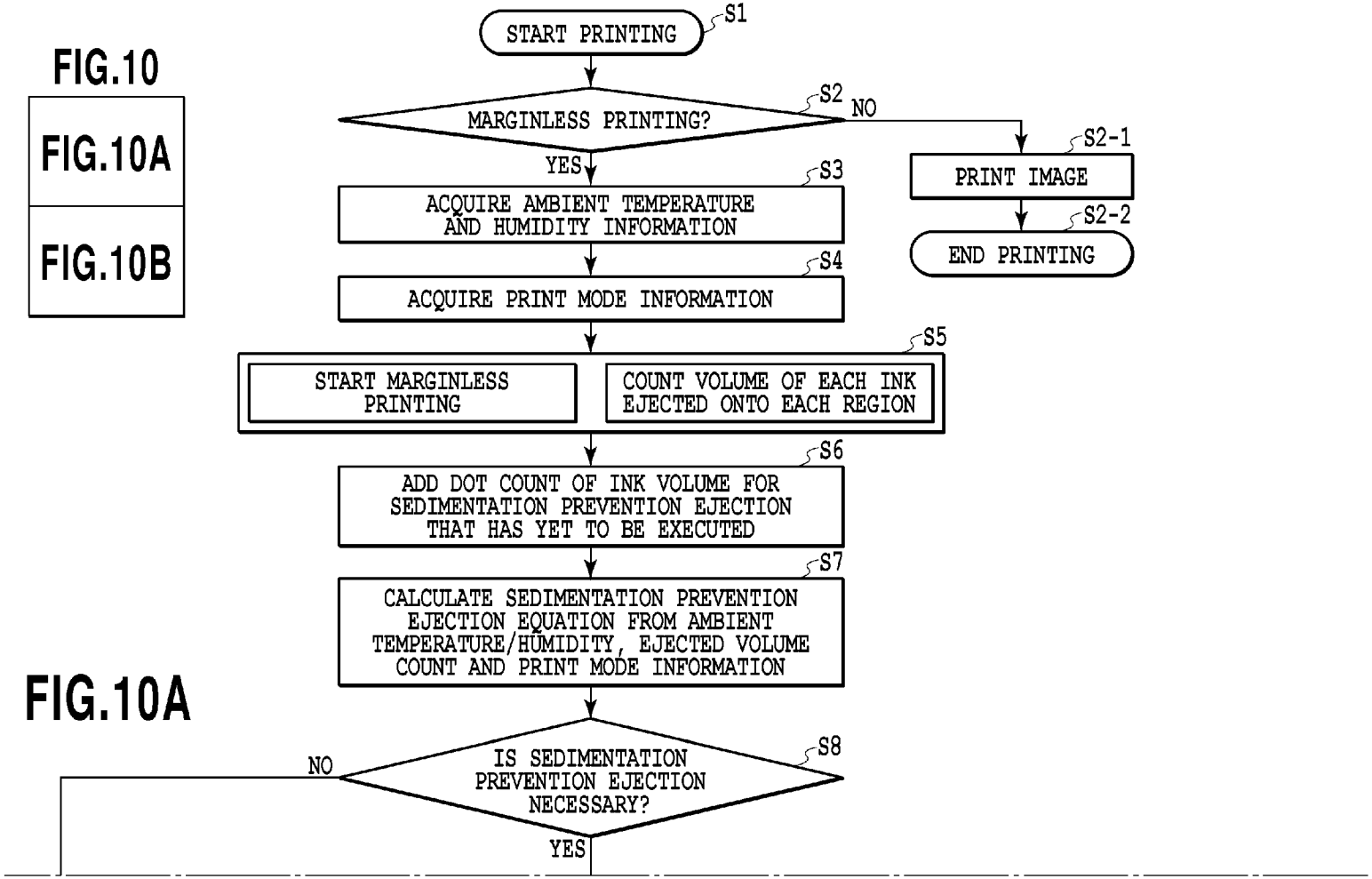
FIG. 10 shows relations of FIG. 10A and FIG. 10B.
FIG. 10A is a flow chart showing a sequence of steps executed by another printing operation.
Figure 10B:
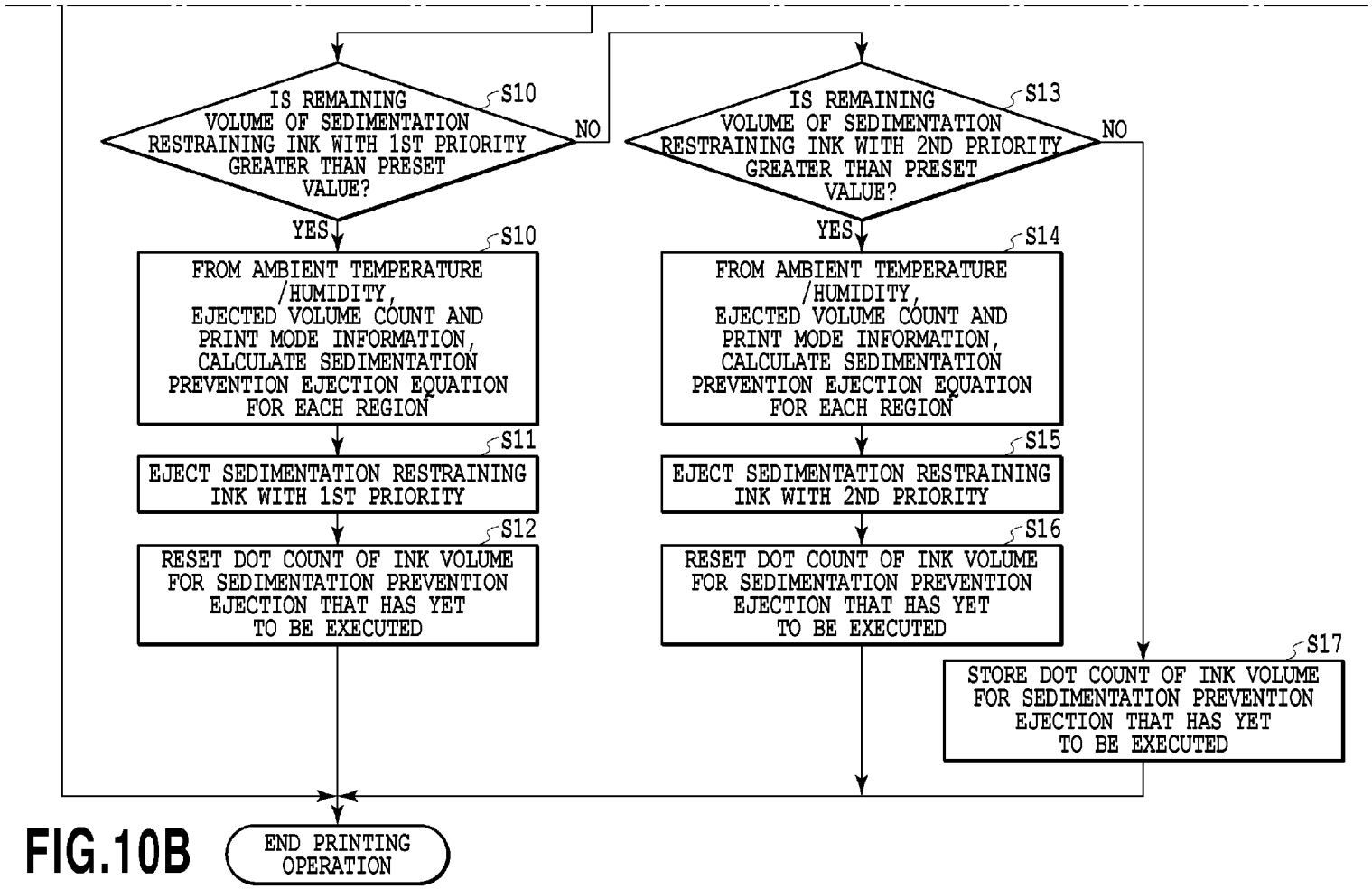
FIG. 10B is a flow chart showing a sequence of steps executed by another printing operation.

FIG. 10 is a flow chart showing a sequence of steps executed in the printing operation of this embodiment. The amount by which the sedimentation restraining inks fall short of what is needed is equally divided between Light Cyan and Gray before they are ejected to prevent ink sedimentation. In this embodiment, the order of priority among the sedimentation restraining inks (second ink group) is determined beforehand and, according to the priority order, the sedimentation prevention ejection is performed. This embodiment uses Light Cyan and Gray of the second ink group for the sedimentation prevention ejection.

The printing operation of this embodiment will be explained by referring to the flow chart of FIG. 10. Step S1 to step S5 are the same as the corresponding part of the flow chart of FIG. 9, so their explanations are omitted.

Step S5 performs a marginless printing and counts the volume of each color ink ejected to each of the beyond-edge regions outside the print medium. To each of the counted ink ejection volumes, step S60 adds a dot count of sedimentation restraining ink that has yet to be ejected for each region. Then step S70 calculates the sedimentation prevention ejection expression (3) for each region based on the temperature/humidity information, the print mode information and the individual ink volumes for each region acquired by steps S3, S4 and S5. Then at step S80, a decision is made of whether or not the sedimentation prevention ejection is needed. This is similar to step S7 in the first embodiment.

When the sedimentation prevention ejection is found not necessary, the printing operation is ended. When the sedimentation prevention ejection is found necessary, the processing moves to step S90, where it checks whether the remaining volume of a sedimentation restraining ink of first priority is larger than a predetermined value. If the remaining volume of the sedimentation restraining ink of the first priority is larger than the preset value, this sedimentation restraining ink is selected for ejection. Then step S100 calculates the amount by which the sedimentation restraining inks fall below the required level, and step S110 ejects the amount that step S100 has calculated of the sedimentation restraining ink of top priority. Then step S120 resets the dot count and exits the printing operation sequence.

If, at step S90, the remaining volume of the sedimentation restraining ink of first priority is smaller than the predetermined value, the processing moves to step S130. Then step S130 checks if the remaining volume of the sedimentation restraining ink of second priority is greater than the predetermined value. If the remaining volume of the sedimentation restraining inks of second priority is found greater than the predetermined value, step S140 calculates the amount that the sedimentation restraining inks fall below the required level and step 150 ejects the amount that step S140 has calculated of the sedimentation restraining ink of second priority. Then step S160 resets the dot count and ends the printing operation.

If at step S130 the remaining volume of the sedimentation restraining ink of second priority is found less than the predetermined value (i.e., consumption of this ink is greater than a predetermined value), step S170 resets the dot count and ends the printing operation.

It is noted that any ink colors may be used as the sedimentation restraining inks and that their ejection volumes may be determined by weighting according to their sedimentation prevention effectiveness. Further, although two sedimentation restraining inks of first and second priority are used in this embodiment, the number of these sedimentation restraining inks is not limited to two, and two or more of them may be used.

The order of priority given to the sedimentation restraining inks is preferably determined in the order of sedimentation prevention effectiveness. However, where this preference has significant effects on ink consumption as a result of the sedimentation prevention ejection, as when the ink cartridge size varies among different ink colors, the priority order need not be based on the sedimentation prevention effectiveness. It may be determined in a way that minimizes uneven ink consumption or frequency of use among different ink colors, or according to the combination of these two methods.

As described above, a volume comparison is made between the easily sedimenting inks and the sedimentation restraining inks based on the ink components. When the sedimentation restraining ink volume is not enough, only the required amount of the sedimentation restraining ink is ejected. This minimizes the volume of the sedimentation restraining inks applied to the platen ink absorber 13, thereby realizing an inkjet printing apparatus capable of properly preventing the ink sedimentation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194746, filed Aug. 31, 2010, which is hereby incorporated by reference herein in its entirety.

What is claimed is:

1. An inkjet printing apparatus comprising:

a printing device having a first ink group and a second ink group, which prevents a sedimentation of the first ink group;

a platen ink absorber configured to receive inks ejected from the printing device during a marginless printing;

a counting device configured to count, for each of a plurality of regions into which the platen ink absorber is divided, ink volumes of the first ink group and the second ink group ejected from the printing device;

an estimation device configured to estimate a ratio of the first ink group and the second ink group for each of the plurality of regions; and an ink providing device configured to provide an ink of the second ink group when the estimation by the estimation device indicates that an ink of the first ink group sediments, wherein a priority order is established in the second ink group, and the ink providing device provides the ink of the second ink group based on the priority order.

2. An inkjet printing apparatus according to claim 1, wherein the priority order represents an order in which an ink with a higher sedimentation prevention effectiveness or with a higher frequency of use is preferentially used, or an order so determined as to preferentially use both of an ink with a higher sedimentation prevention effectiveness and an ink with a higher frequency of use.

3. An inkjet printing apparatus according to claim 1, wherein, when a used volume of an ink with a higher level of priority is greater than a predetermined value, the ink providing device selects an ink with a lower level of priority whose used volume of ink is less than the predetermined value.

4. An inkjet printing apparatus according to claim 1, wherein the plurality of regions of the platen ink absorber include leading, trailing and left/right beyond-edge portions outside the print medium.

5. An inkjet printing apparatus according to claim 1, wherein the estimation device is further configured to estimate the ratio of the first ink group and the second ink group ejected onto the platen ink absorber for each of the plurality of regions, and estimates the ratio by using at least one of: temperature and humidity information in a printing environment, print mode information, a time that has passed from the ink ejection, an accumulated number of marginless-printed sheets, and an amount of sedimentation restraining ink that has yet to be ejected.

6. An inkjet printing apparatus which can perform margin-less printing comprising:

a printing head which can eject a first ink group, which is likely to produce ink sediment, and a second ink group, which is likely to restrain ink sedimentation;

a supporting member provided in a position in which the supporting member faces the printing head to support a printing medium;

a calculation unit configured to calculate a total quantity which is a sum of (i) a first quantity of liquid necessary to restrain ink sedimentation based on ink quantities of the first ink and the second ink which are ejected to the supporting member before the printing movement for the printing medium is carried out during the margin-less printing movement multiplied by a first coefficient, and (ii) a second quantity of liquid necessary to restrain ink sedimentation based on the ink quantities of the first ink and the second ink which are ejected to the supporting member after the printing movement for the printing medium is carried out during the margin-less printing movement multiplied by a second coefficient different from the first coefficient; and a control unit configured to perform control to eject an amount of a liquid necessary to restrain ink sedimentation equal to the total quantity calculated by the calculation unit to the supporting member after margin-less printing movement.

7. An inkjet printing apparatus according to claim 6, wherein the first coefficient is larger than the second coefficient.

8. An inkjet printing apparatus according to claim 6, wherein the liquid necessary to restrain ink sedimentation is the second ink group.

9. An inkjet printing apparatus according to claim 8, wherein priorities are assigned to multiple inks included in the second ink group, and the control unit controls which ink among the multiple inks is ejected to the supporting member according to the priorities.

10. An inkjet printing apparatus according to claim 6, wherein the supporting member has an ink receptacle portion which receives ink ejected from the printing head.

11. An inkjet printing apparatus according to claim 6, further comprising:

an adjustment unit which adjusts the coefficient based on a humidity and temperature.

12. An inkjet printing apparatus according to claim 6, wherein the calculation unit calculates the total quantity by adding the first quantity, when the first quantity is a positive value, and calculates the total quantity without adding the first quantity when the first quantity is a negative value, and calculates the total quantity by adding the second quantity, when the second quantity is a positive value, and calculates the total quantity without adding the second quantity when the second quantity is a negative value.

13. An inkjet printing apparatus according to claim 6, wherein the control unit performs control to eject the amount of the liquid necessary to restrain ink sedimentation equal to the total quantity after the printing medium is discharged from the inkjet printing apparatus.

14. An inkjet printing apparatus which can perform margin-less printing comprising:

a printing head which can eject a first ink, which is likely to produce ink sediment, and a second ink, which is likely to restrain ink sedimentation;

a supporting member provided in a position in which the supporting member faces the printing head to support a printing medium;

a calculation unit configured to calculate a total quantity which is a sum of (i) a first quantity of liquid necessary to restrain ink sedimentation based on ink quantities of the first ink and the second ink which are ejected to the supporting member before the printing movement for the printing medium is carried out during the margin-less printing movement multiplied by a first coefficient, and (ii) a second quantity of liquid necessary to restrain ink sedimentation based on ink quantities of the first ink and the second ink which are ejected to the supporting member after the printing movement for the printing medium is carried out during the margin-less printing movement and multiplied by a second coefficient different from the first coefficient; and a control unit configured to perform control to eject an amount of liquid necessary to restrain ink sedimentation equal to the total quantity calculated by the calculation unit to the supporting member after margin-less printing movement.

15. An inkjet printing apparatus comprising:

a printing head which can eject a first ink group, which is likely to produce ink sediment, and a second ink group, which is likely to restrain ink sedimentation;

an ink absorber configured to absorb ink ejected by the printing head when performing margin-less printing;

a first calculation unit configured to calculate a first ink quantity, which is a quantity of ink that settles in the ink absorber when printing at a leading edge of a printing medium, based on quantities of the first ink group and the second ink group ejected when performing margin-less printing at the leading edge of the printing medium;

a second calculation unit configured to calculate a second ink quantity, which is a quantity of ink that settles in the ink absorber when printing at a trailing edge of the printing medium, based on quantities of the first ink group and the second ink group ejected when performing margin-less printing at the trailing edge of the printing medium; and a determining unit configured to determine a quantity of an application ink to be applied to the ink absorber based on the first ink quantity and the second ink quantity.

16. An inkjet printing apparatus according to claim 15, wherein the determining unit determines the quantity of the application ink based on the first ink quantity multiplied by a first coefficient and the second ink quantity multiplied by a second coefficient different from the first coefficient.

17. An inkjet printing apparatus according to claim 16, wherein the first coefficient is larger than the second coefficient.

18. An inkjet printing apparatus according to claim 15, wherein the application ink is one of the second ink group.

19. An inkjet printing apparatus according to claim 15, further comprising:

a platen configured to support a print medium at a position opposite to the printing head, wherein the ink absorber is provided on the platen.

20. An inkjet printing apparatus according to claim 15, wherein the ink absorber is configured such that the absorbed ink includes ink which spills out from the printing medium when margin-less printing is performed.

* * * * *